US005735732A

United States Patent [19]

Bernard

[11] Patent Number: 5,735,732

[45] Date of Patent: Apr. 7, 1998

[54] PRECISION DRILL SHARPENER AND GRINDING WHEEL ASSEMBLY THEREFOR

[76] Inventor: David A. Bernard, P.O. Box 277, Ashland, Oreg. 97520

[21] Appl. No.: 675,881

[22] Filed: Jul. 5, 1996

[51] Int. Cl.[6] ..... B24B 5/00

[52] U.S. Cl. ..... 451/242; 451/178; 451/278; 451/375; 451/449; 279/60

[58] Field of Search ..... 457/143, 140, 457/138, 48, 241, 242, 449, 550, 375, 376, 178, 278; 279/60, 64, 358

[56] References Cited

U.S. PATENT DOCUMENTS

| | | | |
|---|---|---|---|
| 2,109,308 | 2/1938 | Adams . | |
| 2,377,271 | 5/1945 | Schumann | 451/449 |
| 2,881,066 | 4/1959 | Amiet | 279/53 |
| 3,126,679 | 3/1964 | Abadjieff | 451/375 |
| 4,093,247 | 6/1978 | Bernard et al. . | |
| 4,471,581 | 9/1984 | Bernard et al. . | |
| 4,485,596 | 12/1984 | Bernard et al. . | |
| 4,551,948 | 11/1985 | Kindig et al. | 451/375 |
| 4,916,866 | 4/1990 | Bernard et al. . | |
| 5,031,925 | 7/1991 | Tatsu et al. | 279/60 |
| 5,062,322 | 11/1991 | Sinko | 451/278 |
| 5,097,634 | 3/1992 | Hulme . | |
| 5,179,809 | 1/1993 | Schroeder . | |
| 5,400,546 | 3/1995 | Christian et al. . | |
| 5,549,509 | 8/1996 | Hirst et al. | 451/178 |

FOREIGN PATENT DOCUMENTS

| | | | |
|---|---|---|---|
| 3342914 | 6/1985 | Germany | 451/375 |

OTHER PUBLICATIONS

Darex brochure entitled: "Darex Super Precision Drill Sharpeners: Reflect the Quality of Your Work".

SP 2000 and SP 2500 Super Precision Drill Sharpeners User's Guide.

*Primary Examiner*—Robert A. Rose

*Assistant Examiner*—George Nguyen

*Attorney, Agent, or Firm*—Kerkam, Stowell, Kondracki & Clarke, P.C.; John C. Kerins

[57] ABSTRACT

A precision drill sharpener and grinding wheel assembly is provided, as is a corresponding drill chuck for use with the drill sharpener, in which the drill sharpener includes a lever and spring clip alignment subassembly for properly positioning a drill in the drill chuck, and sharpening ports for sharpening the drill and splitting the drill tip, the sharpening ports being positioned such that a single grinding wheel assembly is used to both sharpen the drill and split the tip. The drill sharpener uses a small diameter grinding wheel operated at high speed to provide cutting rates comparable to large industrial sharpeners. The drill chuck is of short length, relative to most of the drills to be sharpened, and is open at a back end, enabling the manipulation of the drill by its shank relative to the drill chuck when disposed in the alignment subassembly.

23 Claims, 7 Drawing Sheets

FIG. 13
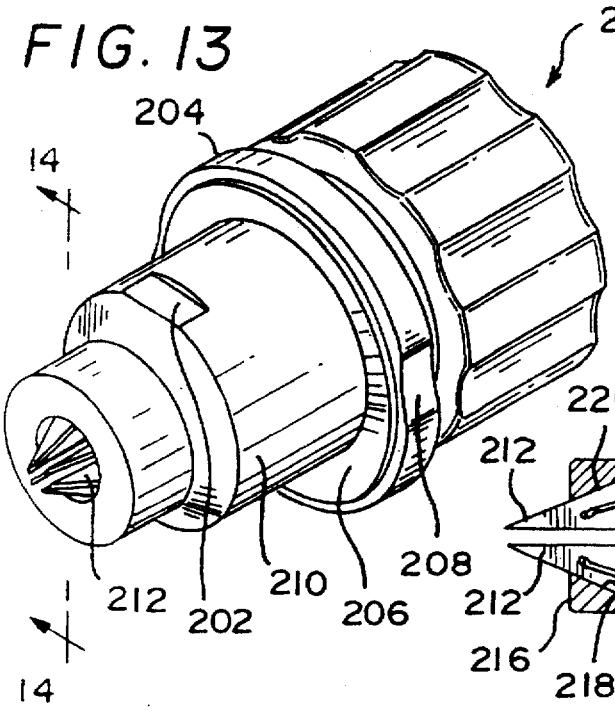
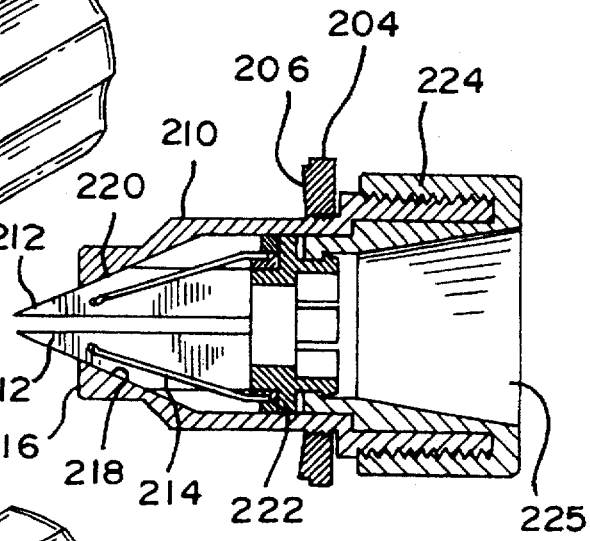
FIG. 14
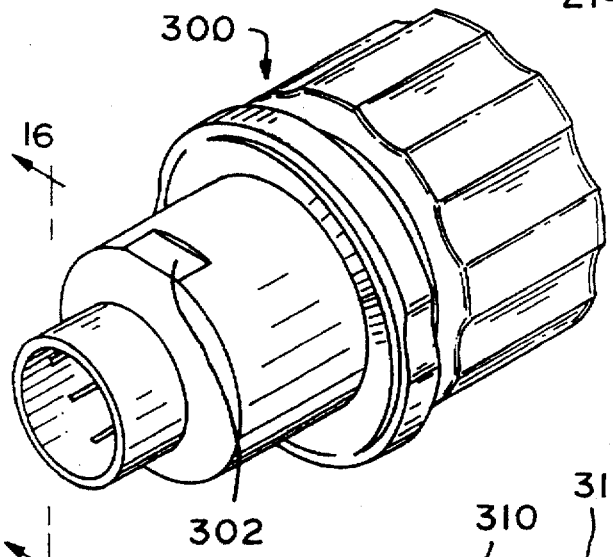
FIG. 15
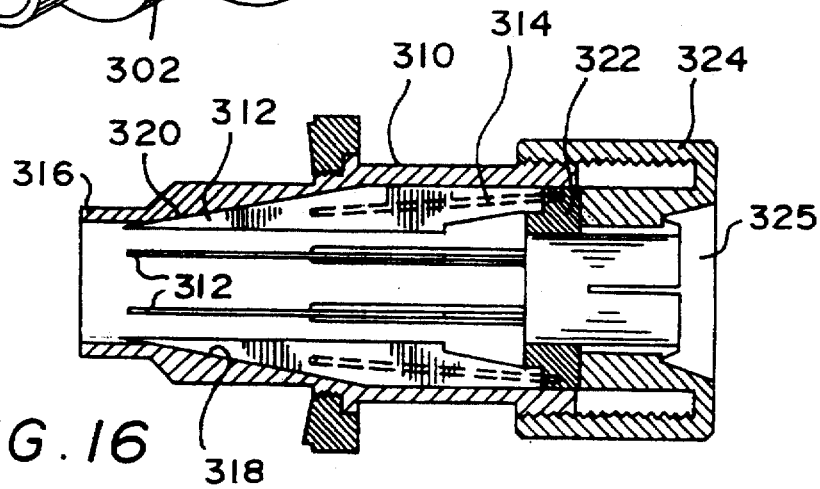
FIG. 16

PRECISION DRILL SHARPENER AND GRINDING WHEEL ASSEMBLY THEREFOR

BACKGROUND OF THE INVENTION

1. Field of the Invention

The present invention is directed to a precision drill sharpener and a grinding wheel assembly adapted to be used with the precision twist drill sharpener.

2. Description of Related Art

There are a number of drill sharpener machines available today, some of which can sharpen common twist drills to a like-new drill geometry. However, many of those machines require rather skilled operators, and others only approach standardized drill geometry.

U.S. patents directed to drill sharpener machines and attachments, such as twist drill chucks, include: U.S. Pat. Nos. 4,916,866, Bernard et al; 4,485,596, Bernard et al.; 4,471,481, Bernard et al; and 4,001,975, Bernard et al. The recently issued Christian et al. patent, U.S. Pat. No. 5,400,546, presents a design that all but eliminates the need for skilled operators, and substantially removes all of the guess work from sharpening the drills.

Historically, common twist drills have been a very standardized tool. The geometry at the cutting end was a standardized geometry, generally selected by the Metal Cutting Tool Institute as the best geometry for all general purpose drilling, and had an included point of 118°, a lip relief of 6° to 18° (depending on drill diameter), and a chisel edge accurate to within 0.004 inch with the axis of the drill. In recent years, many new drill point geometries have become commonly used for special and general purpose drilling. The most prominent variations on the standard 118° point are the 118° "S" or Spiral point, the 135° split point, or a combination of the two. In addition, a higher degree of chisel edge accuracy, down to 0.002 inch, is becoming more common. These new points are being used more and more because of their superior cutting ability, self-centering characteristics and ability to produce more accurate holes. Currently, about 30% to 40% of all twist drills produced in the United States are made with one of these point variations. Drills with the traditional standard point geometry, or the other mentioned variations, are purchasable at hardware stores and industrial supply distributors by homeowners, hobbyists, auto mechanics, building tradesmen, millwrights and machinists.

Good-quality, high-speed, steel twist drills are expensive; for example, the average current list price for ⅛-inch size, with a traditional 118° point, is about $0.60; for 5/16-inch size, about $1.75; and for ½-inch size, about $4.00. Prices for drills with "special" drill points are usually double in cost. Even with the twist drills being so expensive, only a very small percentage of the twist drills purchased are ever resharpened, because it has been very difficult for even a master machinist to resharpen the cutting tips by hand and produce the most efficient or desired geometry. Generally, drills resharpened by hand remove material inefficiently, quickly become overheated, lose their sharpness and are soon scrapped.

For these reasons, thousands of persons using twist drills scrap a number of twist drills per day at an estimated average cost of $2.00 per each drill. Such loss can amount to a hundred or more dollars per week per manufacturer.

The size of possibly not less than 95 percent of all twist drills manufactured and used is within the range of 1/16 inch and ¾ inch in diameter, and within this range, there are many fractional-inch sizes, letter sizes, numeral sizes and millimeter sizes. One of the main objects of this invention is to provide a drill sharpener whereby all of these different sizes of drills, about 300 in all, can be handled by one super precision drill sharpener mechanism.

It is also a primary object of this invention to provide a precision drill sharpener that attains the goals accomplished by the sharpener design in the aforementioned Christian et al. patent, e.g., eliminating guess work and the need for skilled operators in order to obtain precision sharpening, while providing various enhancements, such as a highly compact design, a new grinding wheel assembly configuration, and a machine that is substantially highly economical to manufacture, such that it can be affordable to hobbyists, home craftsmen, auto mechanic shops and building tradesmen.

It is an additional important object of the present invention to provide a simple lever and spring clip subassembly as a means for properly aligning or timing a drill in the drill chuck.

It is an additional important object of the present invention to provide an adjustment mechanism for changing the angle at which the drill point will be sharpened, and a corresponding adjustment mechanism for properly aligning the drill in the chuck for the proper drill point angle.

It is a further important object of the present invention to provide a drill chuck that is open at its back end to allow for manual manipulation of the drill while the drill and chuck are disposed in the alignment port, in order to effect the proper alignment or timing of the drill.

It is a further object of the present invention to provide a drill sharpener using a small diameter grinding wheel operated at high speed to provide cutting rates comparable to large industrial sharpeners, but that will not overheat and thus be rendered ineffective by such overheating.

It is a further object of the present invention to provide a grinding wheel construction that will electrically insulate a steel grinding wheel from the motor shaft to which it is fastened in a direct drive system.

It is yet an additional object of the present invention to provide a drill sharpening device having a point-sharpening port and a point-splitting port each oriented such that the same grinding surface on the grinding wheel is used to both sharpen and split the point.

SUMMARY OF THE INVENTION

The above and other objects of the invention are accomplished by providing a drill sharpener that is compact in design, using a high-speed, small diameter diamond-plated grinding wheel to quickly and efficiently sharpen the drills. The sharpener has a simple drill alignment system employing a button or lever-operated pair of alignment clips and a chuck that is open and accessible from the back end of the chuck. The port containing the drill alignment clips is disposed in the same housing as is the grinding wheel and its associated ports.

The alignment port, the drill chuck, and the primary sharpening port are all designed such that the alignment port may be rotated or reoriented to properly align drills having different drill point geometries, and the primary sharpening port is similarly adjustable to present the drill point to the grinding wheel at the desired angle. The primary sharpening port and the point-splitting port are arranged at diametrically opposed positions on either side of the grinding wheel of the drill sharpener, and each of these ports is designed to receive the chuck to present the drill point to the same grinding wheel surface at appropriate orientations such that the same grinding surface is used to sharpen the drill point, and, where desired, to split the drill point, or resharpen the split point surfaces.

The grinding wheel has several important design features that have been developed and incorporated so that the sharpener can meet the requirements for UL (Underwriters' Laboratories) listing approval. The body or substrate of the grinding wheel would normally be solid steel, an electrically conductive metal. The motor shaft, also made of steel, is required to be electrically insulated from the grinding wheel in order to obtain UL approval. The grinding wheel is thus made up of central hub made of a high-temperature plastic material, and having a diamond-plated steel grinding ring disposed at an upper peripheral position, with the grinding ring member secured to the plastic hub by a circular cast aluminum heat sink disk. The plastic hub has a central bore and is press fitted onto the steel motor shaft, thus electrically isolating the shaft from the steel grinding ring member.

The high speed at which the motor operates, and the use of a small diameter grinding ring, result in a potential to generate enough heat to melt even high-temperature-rated plastics, so the finned aluminum heat sink disk serves the dual purpose of retaining the grinding ring in position and carrying away the excessive heat generated in the grinding operation.

BRIEF DESCRIPTION OF THE DRAWINGS

These and other features of the present invention and the attendant advantages will be readily apparent to those having ordinary skill in the art, and the invention will be more easily understood from the following detailed description of the preferred embodiment taken in conjunction with the accompanying drawings wherein like reference characters represent like parts throughout the several views.

FIG. 13 is a perspective view of a chuck used with the drill sharpener of the present invention, as designed to hold small-diameter drills.

FIG. 14 is a cross-sectional view of the chuck of FIG. 13, taken along section line 14—14 of FIG. 13.

FIG. 15 is a perspective view of a chuck used with the drill sharpener of the present invention, as designed to hold larger-diameter drills.

FIG. 16 is a cross-sectional view of the chuck of FIG. 15, taken along section line 16—16 of FIG. 15.

DETAILED DESCRIPTION OF THE PREFERRED EMBODIMENTS

Figure 1:
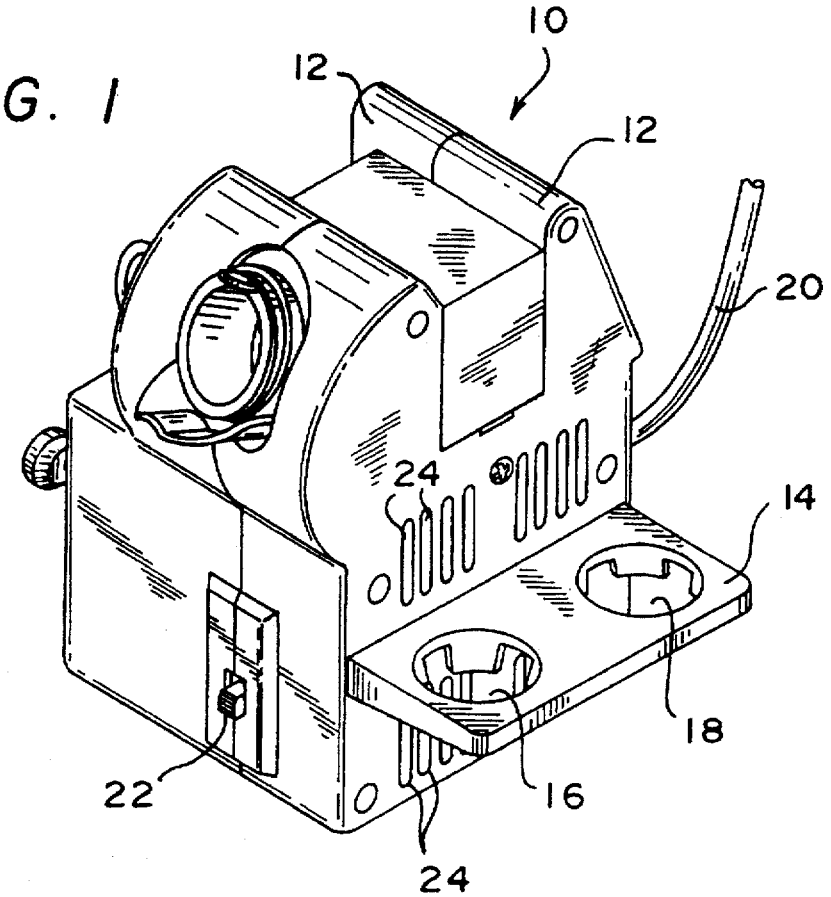
FIG. 1 is a perspective view of the drill sharpener according to the preferred embodiment of the present invention.

Referring initially to FIG. 1, the drill sharpener 10 is illustrated from the side and rear thereof. The housing 12 is fabricated in two sections, and houses therein an electric motor and a grinding wheel assembly, and has openings containing various access ports. The rear of the housing 12 has a shelf 14 protruding therefrom, and the shelf preferably has two openings 16, 18 therein sized to hold the two drill chucks 200, 300 (FIGS. 13–16) that are preferably provided with the drill sharpener and form a part of the overall sharpening system.

The motor of the drill sharpener 10 runs on electric power supplied preferably through a standard cord 20. The motor is turned on and off at switch 22. Venting slots 24 are provided in the housing 12 to allow air exchange between the interior of the housing and the exterior of the housing.

Figure 2:
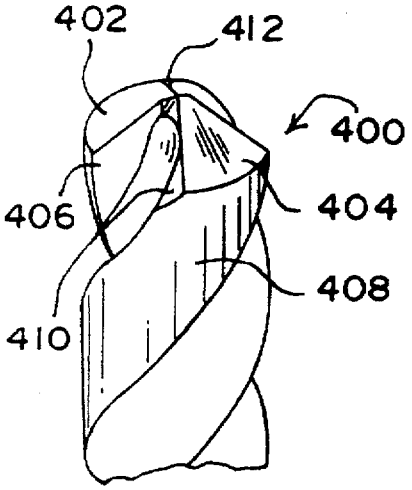
FIG. 2 is a partial perspective view of a drill having a split-point drill point geometry that can be suitably sharpened by the drill sharpener of the present invention.

Prior to discussing the actual operation of drill sharpener 10, the various drill point geometries that can suitably be sharpened by this drill sharpener will be discussed briefly with reference being made to FIGS. 2–4. FIG. 2 illustrates the drill point geometry of a split-point drill 400, having a 135° point formed by the chisel edges 402, 404 at the cutting end of the two spiraled sections of the drill 406, 408. The chisel edges are further ground in a plane substantially parallel to the longitudinal axis of the drill, thereby splitting or disconnecting the portions of the chisel edges at the two flutes at the point of the drill. The ground surfaces 410, 412 can be resharpened in the split point port of the drill sharpener of the present invention.

Figure 3:
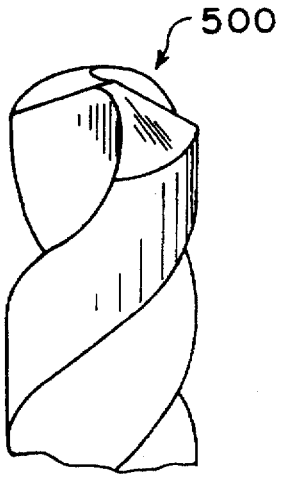
FIG. 3 is a partial perspective view of a drill having a spiral point drill point geometry that can be suitably sharpened by the drill sharpener of the present invention.
Figure 4:
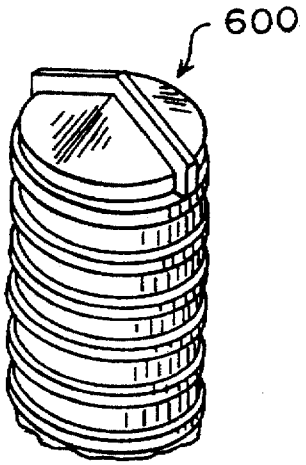
FIG. 4 is a partial perspective view of a carbide-tip drill that can be suitably sharpened by the drill sharpener of the present invention.
Figure 5:
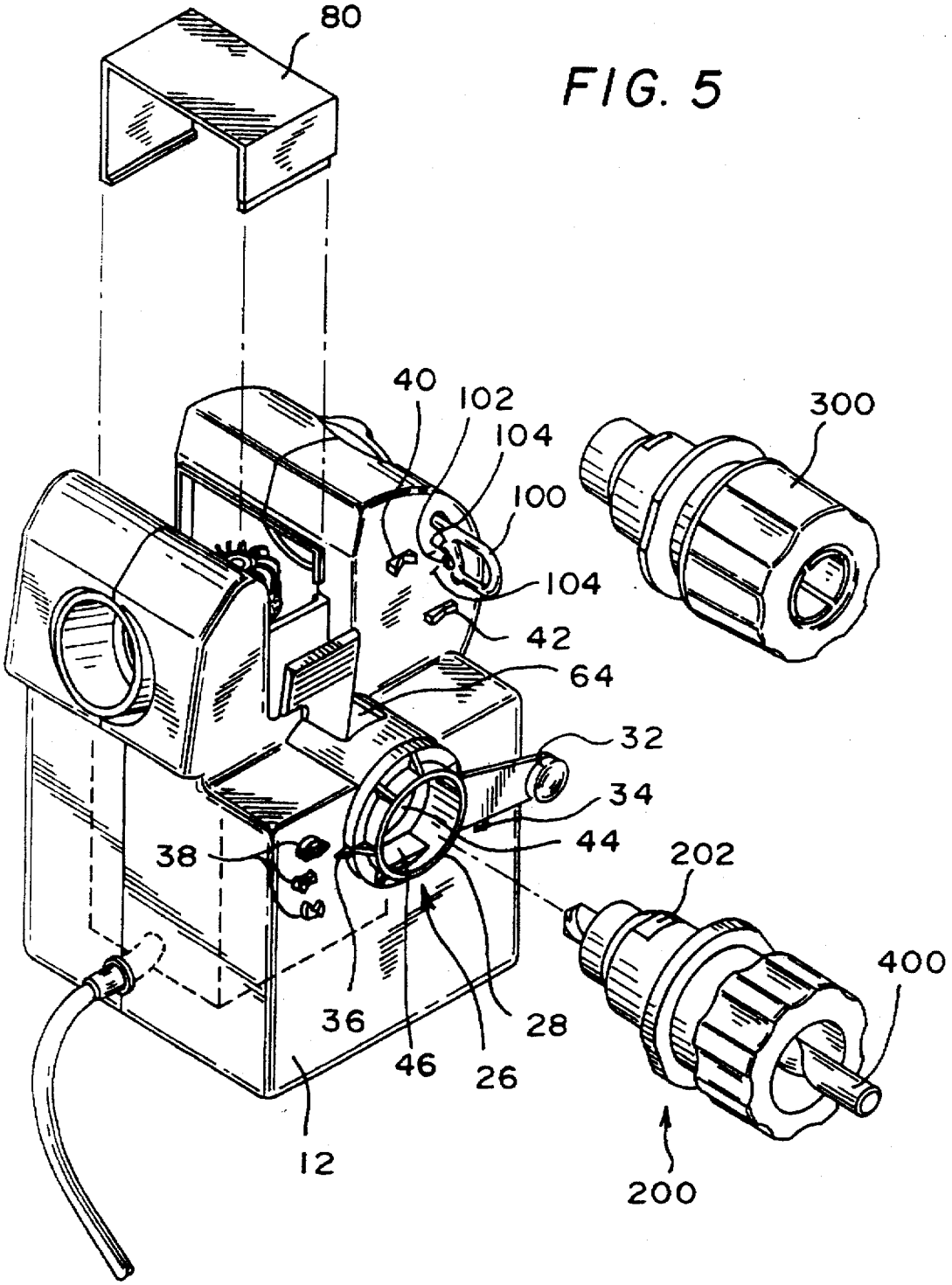
FIG. 5 is a partially exploded perspective view of the drill sharpener of the present invention and the chucks that are used in conjunction with the drill sharpener in accordance with a preferred embodiment of the present invention.
Figure 6:
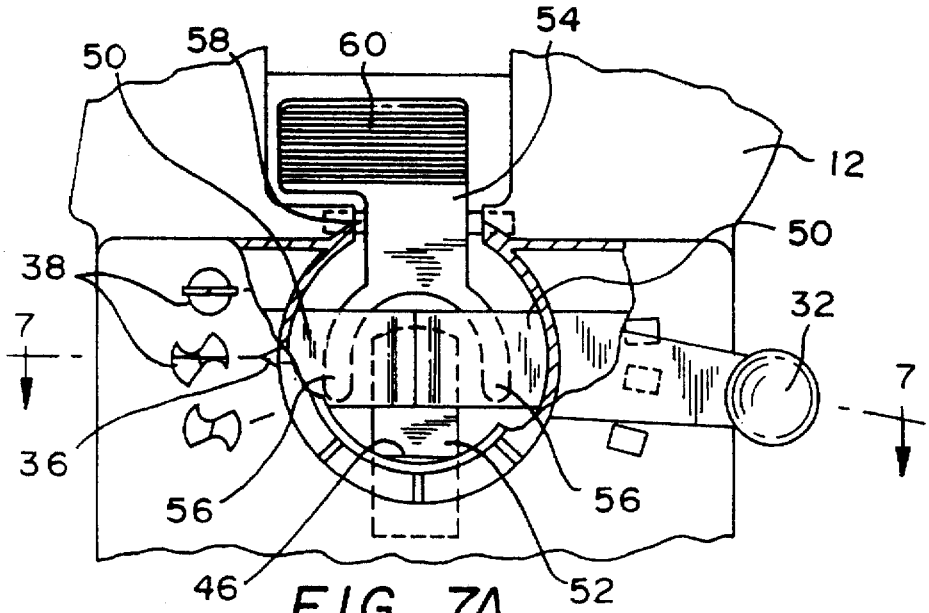
FIG. 6 is a partial front elevation and partial cutaway view of the drill sharpener according to a preferred embodiment of the present invention showing the alignment port.

FIG. 3 illustrates the drill point geometry of a standard 118° drill 500. FIG. 4 illustrates the drill point geometry of a standard carbide-tipped drill 600. As will be described hereinafter, the chucks, alignment port and sharpening and point-splitting ports are configured to accept all three types of drills and drill point geometries and to permit efficient and accurate sharpening of the points without requiring any extensive training or skill in order to operate the sharpener.

Figure 17:
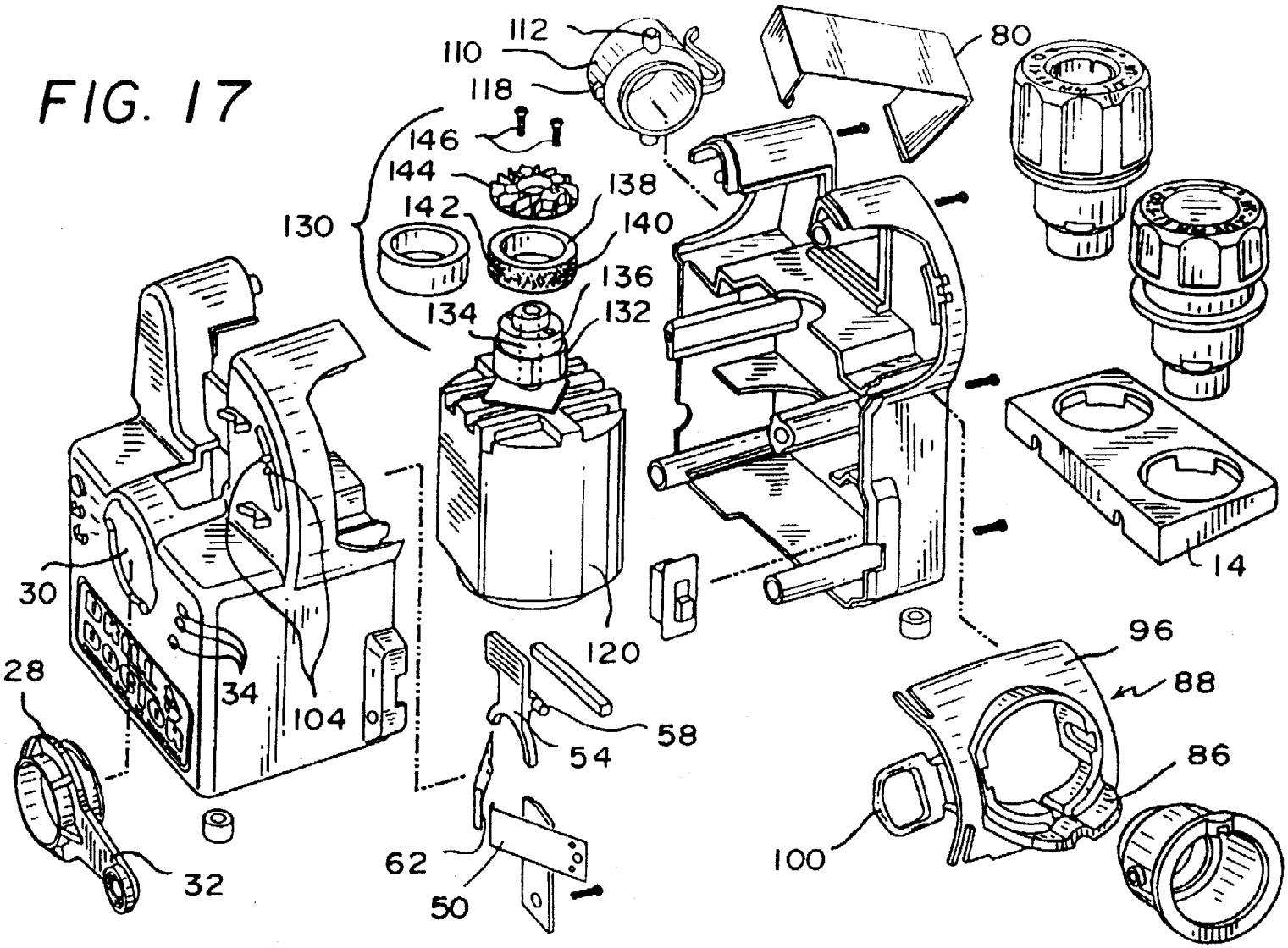
FIG. 17 is an exploded perspective view of the components of the drill sharpener of the present invention.

FIGS. 5, 6, 7A and 7B will now be referred to in describing the components of the drill alignment subsystem. Alignment port 26 is made up of an alignment port chuck holder 28 that is rotatably mounted through an opening 30 (FIG. 17) in housing 12. In this depicted preferred embodiment, the chuck holder 28 may be rotated into three fixed desired positions, by rotating arm 32 having a projection 33 (FIG. 7A, 7B) on a back side thereof, into position to engage the desired one of the three detents 34 provided in housing 12. The position of the chuck holder may easily be changed by pulling forward slightly on arm 32 to clear the projection out of the detent, and then rotating the arm to the desired position.

A pointing projection 36 is positioned to be diametrically opposite the chuck holder arm 32, and the housing 12 is provided with indicia 38 whereby the user is provided with a visual indication of the correct position of chuck holder 28 for use in aligning the three different types of drills, e.g., drills 400, 500, 600, to subsequently be sharpened. As illustrated, the indicia 38 are physical representations of a 118° point, a 135° split point, and a carbide-tipped drill, integrally molded in the housing, thus facilitating an actual comparison of the drill point to be sharpened to the indicia 38, as necessary. In addition to the alignment indicia 38, point angle gages 40, 42 are also preferably integrally molded with housing 12. These gages permit the drill point to be presented to the gages, and the user will determine which gage 40, 42 best fits the drill point, and be able to read the numerical valve (typically 118° and 135°) of the angle of the drill point to be sharpened.

The chuck holder 28 has a generally circular opening 44 therein, and has two diametrically opposed projections 46 that present straight parallel chuck retaining faces projecting into the opening 44. The retaining faces 46 are sized to mate with diametrically opposed flats 202 on the chuck 200 to fix the chuck 200, once inserted into the alignment port 26, relative to the chuck holder, and substantially preventing relative rotation between the chuck 200 and chuck holder 28. As will be readily appreciated, the chuck holder 28 will retain the chuck at a different orientation, in a rotational sense, for each of the different types of drill points to be sharpened. This will ensure that each type of drill is properly timed for later insertion into the main sharpening port.

The chuck 200 is provided with two sets of camming surfaces, the specific purpose of which will be discussed later, but which require the drill, for example, drill 400, to be properly positioned and retained in the chuck 200. This is accomplished by loosely placing the drill 400 in the chuck 200, and then fully inserting the chuck into chuck holder 28 such that the opposing retaining faces 46 engage the flats 202 on the chuck. Once this is accomplished, spring clips 50 are separated (see FIG. 7A) to permit the drill 400 to be inserted, by hand manipulation at the open back end of the chuck, past the clips 50 into contact with abutment plate 52. The clips are preferably made of a very thin spring steel, and are held in slots 53 molded into housing 12 such that the clips can readily be elastically deformed or elastically bent back to create a space therebetween by a simple lever operation. Lever 54 has clip engaging tabs 56 extending behind clips 50 (FIG. 6), and is rotated about an integral pin 58 mounted to housing 12 intermediate the tabs 56 and an actuating button 60.

Figure 7A:
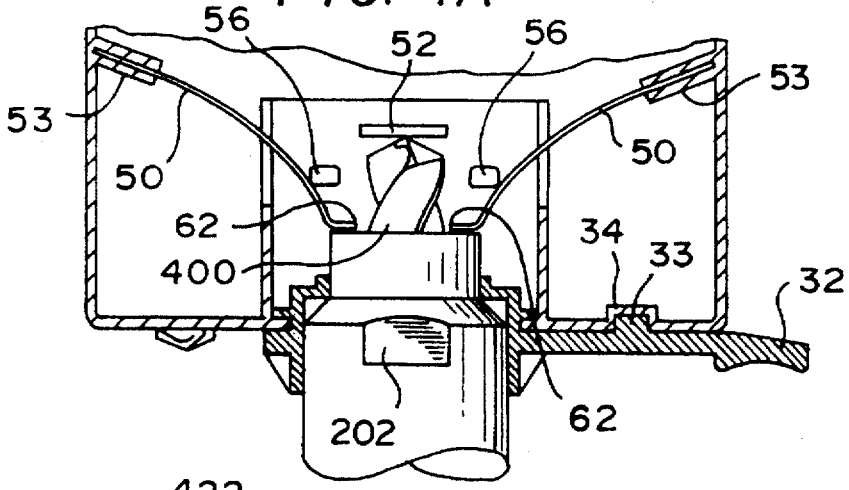
FIGS. 7A and 7B are sectional views taken along line 7—7 of FIG. 6.

Spring clips 50 are installed to be normally biased in their closed position (FIG. 6), and the clips 50 hold back the clip engaging tabs 56 of lever 54, thus biasing button 60 to project outwardly from housing 12. When the button 60 is depressed, the rotation of the lever 54 causes clip-engaging tabs 56 to move outwardly toward the chuck holder 28, thereby separating the leading edges 62 of the spring clips 50 to a distance sufficient to permit the drill to be inserted. (FIG. 7A). Once the drill point is pushed into contact with abutment plate 52, the button 60 is released, and spring clips 50 rebound into contact with the lateral extents of the drill.

Figure 7B:
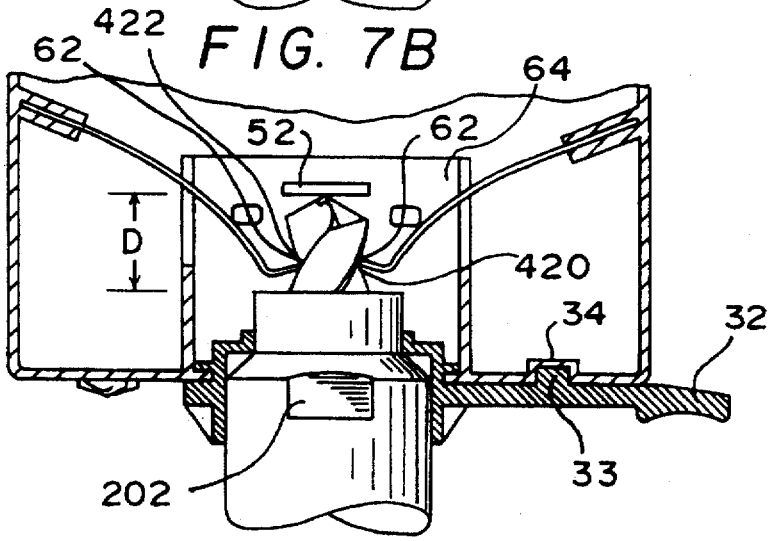

The chuck 200 is positioned in chuck holder 28 such that the drill 400 may be easily aligned relative to the chuck 200 simply by the action of spring clips 50. FIG. 7B illustrates the proper positioning or orientation of the drill 400 within chuck 200. When properly aligned, the leading edges 62 of the spring clips engage the drill in the flutes 420, 422, at the minimum possible separation distance. If the drill is rotated from the position illustrated in FIG. 7B by the person using the device, resistance will be felt, as the drill will attempt to separate the leading edges 62 to a greater separation distance.

The typical alignment of the drill relative to the chuck will involve releasing the button 60 once the drill point is in contact with abutment plate 52, and rotating the drill by hand until a "catch" is felt, when the spring clips reach their closest point of approach or minimum separation distance on the drill flutes. In instances in which the drill is close to being in proper alignment when the spring clips are released, the spring clips themselves may exert sufficient force to rotate the drill to the proper position. Proper alignment can be checked prior to tightening the drill in the chuck by lightly attempting to rotate the drill clockwise and counterclockwise, and confirming that the drill cannot be rotated in either direction unless substantial force is applied. Proper alignment can also be checked through window 64 in housing 12, which allows the viewer to observe whether rotation of the drill is causing the leading edges 62 of spring clips 50 to converge (desired) or to separate. Once the user has obtained the proper alignment, the chuck 200 is then tightened in a manner to be described later to secure the drill in the proper position within the chuck.

It is to be noted that the amount of material to be ground off in sharpening the drill is governed by the preset distance D (FIG. 7B) between the abutment plate 52 and the chuck 200, when the chuck is fully inserted into chuck holder 28. If a drill is badly worn or chipped, such that a single sharpening procedure does not yield a completely sharpened drill point, the sharpening procedure may be repeated any number of times, starting with the alignment step, to advance the drill relative to the chuck, and to thus present new surfaces to be ground.

Once the drill has been properly aligned in the chuck, the drill is ready for sharpening, and, if appropriate, point-splitting or re-surfacing a split point. The sharpening of the drill is accomplished, as will be described in detail later, by simply rotating the chuck in the sharpening port and applying some inward pressure, while the chuck is rotated.

Figure 8:
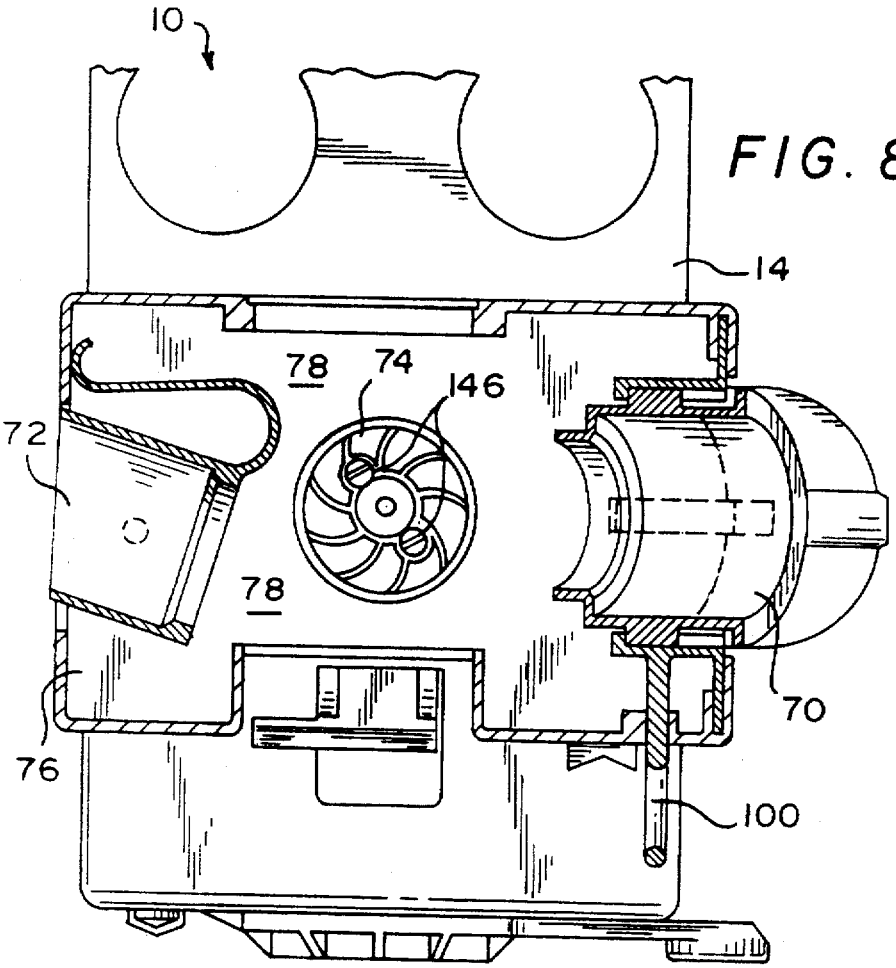
FIG. 8 is a top plan view, partially cutaway, of the drill sharpener in accordance with a preferred embodiment of the present invention.

FIG. 8 is a top cutaway view of the drill sharpener 10 showing the overall positioning of the primary drill sharpening port 70, the point-splitting port 72, and the grinding wheel 74 within a sharpening section 76 of housing 12. The floor 78 of sharpening section 76 collects the material removed in the sharpening process and prevents the same from falling into the motor. A removable, snap-on, hood 80 (FIG. 5) permits ready access to the sharpening section for emptying the material and to reach the grinding wheel 74 for maintenance or any other reason. It can be seen in FIGS. 8–12 and 17 that the primary sharpening port 70 and the point-splitting port 72 are each mounted through openings in the upper port of housing 12 leading into sharpening section 76.

Figure 9:
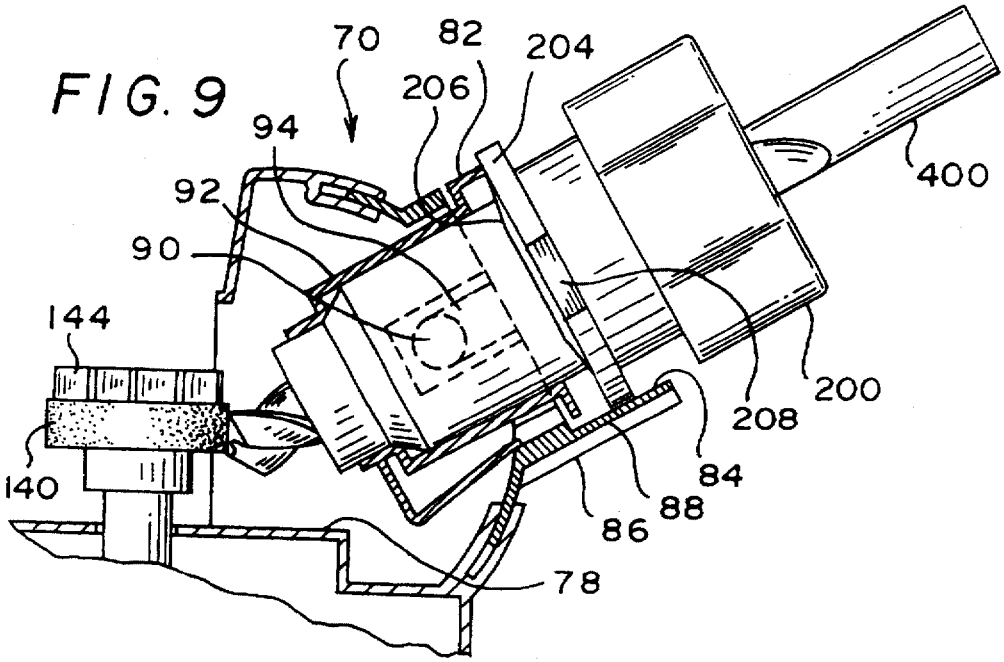
FIG. 9 is a cross-sectional view of the main sharpening port of the drill sharpener a chuck holding a drill therein shown in the point-sharpening position.
Figure 10:
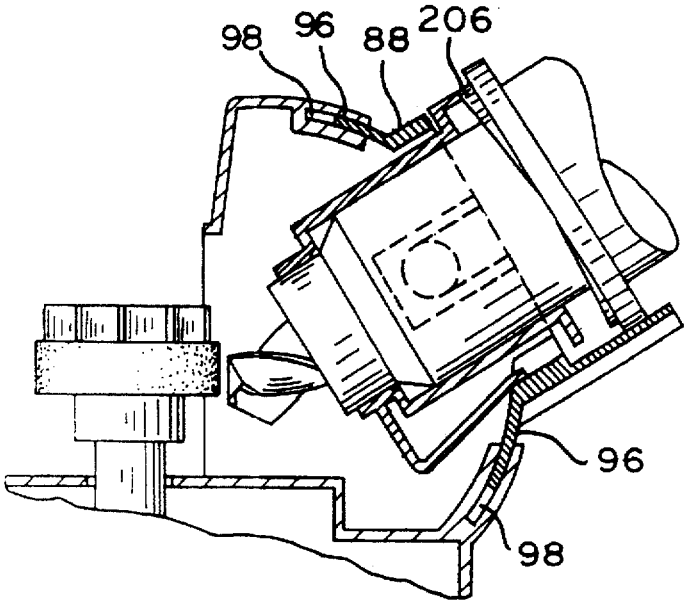
FIG. 10 is a cross-sectional view of the main sharpening port of the drill sharpener with a chuck holding the drill therein shown in a position at which the drill is separated from the grinding wheel.
Figure 11:
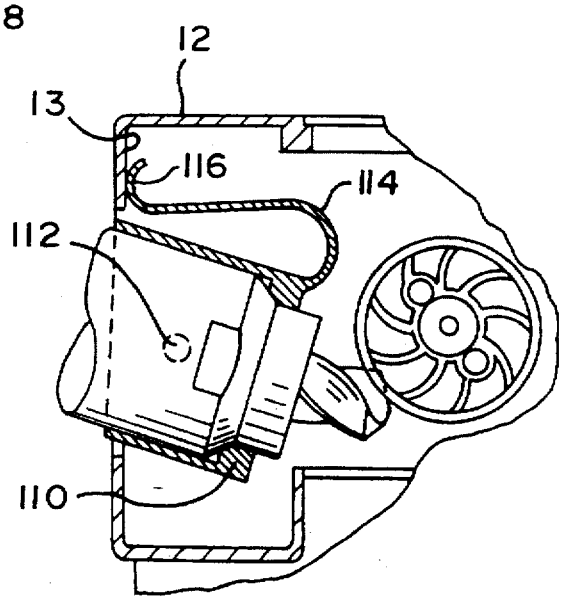
FIG. 11 is a cross-sectional view, taken from the top of the drill sharpener, of the point-splitting port, illustrating the insertion position of the chuck and drill.
Figure 12:
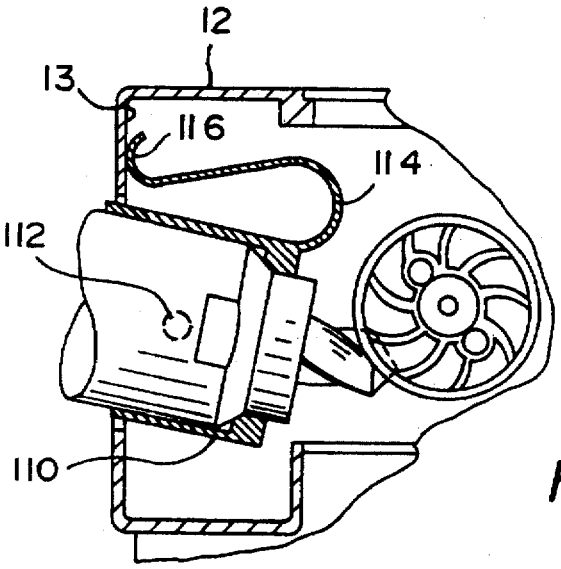
FIG. 12 is a cross-sectional view, taken from the top of the drill sharpener, of the point-splitting port, illustrating the chuck and drill once the drill has been moved into contact with the grinding wheel.

FIGS. 8, 9 and 10 best illustrate the primary sharpening port 70 and the interaction of the port with chuck 200 in sharpening the drill and obtaining the proper contour on the cutting tip of the drill. Reference should be also made to FIGS. 13–16 when the components of the chucks are discussed. A cammed flange 204 is provided on chuck 200 having arcuate cams 206 adapted to engage cam follower 82 on the primary sharpening port 70. The chuck 200 is to be inserted as far as it can be, and one of cams 206 on cammed flange 204 will come into contact with cam follower 82. As can be seen in comparing FIGS. 9 and 10, the interaction of the cams 206 and cam follower 82, when chuck 200 is rotated within sharpening port 70, operates to cycle the chuck and the drill held therein from an innermost position to an outermost position, with the outermost position being slightly exaggerated in FIG. 10. At the same time that chuck 200 is being rotated in the primary sharpening port 70, causing an in-and-out axial cycling of the chuck and drill, a peripheral rocking cammed surface 208 of the cammed flange 204 interacts with a cam follower 84 disposed on a lip 86 extending from outer port member 88. This provides a desired rotation of drill 400 about an axis defined by pins 90 protruding from the sides of chuck-receiving sleeve 92, and seated in slots 94 in outer port member 88. With the drill having been properly aligned in chuck 200 at the alignment port, the in-and-out and rocking movements operate to contour the cutting tip to the desired configuration.

The outer port member 88 in the present invention is further adjustable to accommodate and to properly present to the grinding wheel drills having 118° angled points and having 135° angled points. As can best be seen in FIGS. 9 and 10, in conjunction with FIGS. 5 and 17, the outer port member 88 has a curved mounting flange 96 that mounts in a corresponding curved slot 98 in housing 12. The slot 98 allows limited movement of flange 96 therein. Outer port member 88 is provided with a release handle 100 having a projection 102 thereon that engages one of two detents 104 in housing 12. When it is desired to change from the existing setting, the handle 100 is pulled, the projection 102 escapes the detent that it is currently engaged in, and the handle 100 may be moved, possibly assisted by application of force to lip 86, to move flange 96 within slot 98 to reposition the outer port member 88 and the chuck-engaging sleeve disposed therein to the desired setting. Inward pressure on the handle will cause projection 102 to engage the detent 104 associated with that other position. As can be seen, for example, in FIG. 9, movement of flange 96 within slot 98 changes the angle at which the port, and thus, the chuck and drill, are oriented relative to the grinding wheel.

Point-splitting, or regrinding of the split point surfaces is achieved by inserting the chuck and drill, after the primary sharpening has been accomplished, into a separate point-splitting port 72. The manner in which the chuck is engaged by the point-splitting port sleeve 110 is such that the surface to be ground, even though it is a different surface of the drill than was sharpened in the primary sharpening port, is presented to the same grinding surface on the grinding wheel.

The port sleeve 110 is provided with projections (not shown) similar to those provided in the alignment port, to engage the flats 202 on the chuck to properly orient the chuck and drill in the port 72. The sleeve, which is formed of a relatively thick section of resilient material is mounted in the housing by pins 112 retained in slots (not shown) disposed on the interior surface of housing 12. The pins of port sleeve 110 are mounted to allow a limited amount of rotation about an axis parallel to the axis about which the grinding wheel rotates. The port sleeve 110 has a rebound leg 114 integrally molded with the sleeve, but preferably somewhat thinner in cross-section than the sleeve portion. The leg 114 outwardly and then rearwardly, and is of a length sufficient to have a foot 116 at the end of the leg in contact with the inner wall 13 of housing 12, so as to provide an initial biasing force that will prevent a drill inserted into the sleeve 110 from touching the grinding wheel. Once the chuck has been firmly and fully seated in the port sleeve, the operator of the sharpener may apply force at the rear of the chuck to overcome the initial biasing force, and to rotate the surface of the drill to be ground into contact with the grinding wheel. A stop 118 (FIG. 17) on the opposite side of the sleeve from the leg will operate to prevent the drill from being rotated into a position that will overgrind the surface being treated. Once the first surface has been sharpened, the chuck is removed, rotated 180 degrees, and reinserted in the sleeve 110, so that the opposing surface may be ground to mirror the surface first ground.

Turning now to FIGS. 13–16, the chucks forming a part of the present invention will now be described. The chucks 200, 300, principally vary in terms of the size of the components, in that they operate in substantially the same manner, and one is designed to handle smaller diameter drills, and the other is designed to handle larger diameter drills. In all, these two chucks are capable of handling drills ranging in size from 3/32 inch to ¾ inch, with chuck 200 accepting drills ranging in size from 3/32 inch to ½ inch, and chuck 300 accepting drills ranging in size from ½ inch to ¾ inch.

In addition to other features previously discussed, such as the flats 202 and the cammed flange 204, chuck 200 has a barrel portion 210, chuck jaws 212, chuck jaw springs 214, and a chuck nose portion 216. Chuck jaws have sloping outer faces 218 that cooperate with sloping inner faces 220 on the inner surface of the barrel 210, in closing down on and securing drills of varying sizes therein. The chuck jaws are coupled to a backing ring 222 by way of the chuck jaw springs 214. The backing ring 222 is moved forward toward the nose piece when the chuck is tightened around the drill and pulled rearwardly when the chuck is releasing the drill, by the action of the chuck end piece 224.

Chuck end piece 224 has a hollow cavity 225 extending therethrough, and when assembled to the barrel, results in an open-backed chuck that permits the drill to be held therein to be manipulated from the rear of the chuck, in order to align the drill with respect to the chuck in using the drill sharpener 10. The rear exterior portion of barrel 210 is threaded to engage an inwardly facing set of threads on the end piece 224.

Chuck 300 likewise has flats 302 and a cammed flange 304. Like chuck 200, chuck 300 has a barrel portion 310, chuck jaws 312, chuck jaw springs 314, and a chuck nose portion 316. Chuck jaws have sloping outer faces 318 that cooperate with sloping inner faces 320 on the inner surface of the barrel 310, in closing down on and securing drills of varying sizes therein. The chuck jaws are coupled to a backing ring 322 by way of the chuck jaw springs 314. The backing ring 322 is moved forward toward the nose piece when the chuck is tightened around the drill and pulled rearwardly when the chuck is releasing the drill, by the action of the chuck end piece 324.

Chuck end piece 324 has a hollow cavity 325 extending therethrough, and when assembled to the barrel, results in an open-backed chuck that permits the drill to be held therein to be manipulated from the rear of the chuck, in order to align the drill with respect to the chuck in using the drill sharpener 10. The rear exterior portion of barrel 310 is threaded to engage an inwardly facing set of threads on the end piece 324.

The drill sharpener of the present invention accomplishes the sharpening speed of large industrial sharpeners in a compact package through the use of a compact, high-speed motor 120, and a small diamond plated grinding wheel assembly 130. Industrial sharpeners use much larger wheels and generally rotate much more slowly than the motor speeds believed to work best in the present invention. In the present invention, it is presently believed that motor speeds on the order of 15,000 revolutions per minute (RPM) will be preferable for use in the drill sharpener. Such motors are commercially available, but it is believed that motors having speeds on this order of magnitude have never been used or considered for use in a drill sharpening device.

Alternatively, it is further envisioned that alternative embodiments of the drill sharpener may be designed in which there is no motor supplied as part of the unit, but rather the grinding wheel assembly would be configured to be coupled to an external power source such as the motor of another power tool or piece of power equipment. Additional cost savings could be realized for tradesmen, craftsmen or home hobbyists having such other power equipment.

Small grinding wheels have been used in the past in drill sharpeners, but only grinding wheels using conventional, common abrasives. In the present invention, wherein the sharpener is desirably comparable in cutting rate to the much larger industrial sharpeners, it was recognized that the heat generated by operating the sharpener at the kinds of speeds necessary to achieve comparable rates (in surface feet per minute) would cause the grinding wheel to wear excessively and overheat the tool, or both. In the present invention, it was determined that the excessive wear and overheating problems could be overcome by the use of a diamond-plated steel grinding wheel.

Further problems were encountered when the requirements for obtaining a UL listing or approval for this product, an important aspect, given that the compact sharpener is targeted, at least in part, to homeowners, hobbyists, and building tradesmen. Since the compact nature of the sharpener and economies of manufacture dictated that the sharpener would be a direct drive system, the grinding wheel would be directly mounted on the motor shaft. Motor shafts are almost universally made of conductive metals, such as steel. Typically, a diamond plated grinding wheel would be made from a solid piece of steel having the diamond grit plated thereto. Such a design would not be acceptable, in that the UL required that the motor shaft be electrically insulated from the grinding wheel.

The grinding wheel assembly 130 of the present invention is thus made up of a plastic hub 132, wherein the plastic is of a type having a high temperature rating. The hub can alternatively be made of any high-temperature resistant, non-conductive material. Plastic hub has a bore 134 extending therethrough, which is sized appropriately to be press fitted onto the motor shaft. The plastic hub also has a cylindrical peripheral surface 136 extending along a portion of the longitudinal extent of the hub, sized to receive thereon a hollow metal, preferably steel, cylindrical grinding wheel or ring 138.

The grinding ring 138 has a diamond grit coating 140 plated thereon, preferably only on the outer peripheral cylindrical surface 142 thereof. This economical measure is made possible by the construction of the overall sharpener, and particularly the orientation of the primary sharpening port and the point-splitting port, which both put the surfaces of the drill point to be ground in contact with this outer peripheral cylindrical surface 142 to effect the sharpening. The grinding ring is maintained in position on the plastic hub 132 by an aluminum heat sink disk 144, that is itself secured to the plastic hub by a pair of retaining screws 146. The heat sink provides an extra measure of safety, in that the speed at which this sharpener operates can generate sufficient heat to melt even the high-temperature-rated plastics, and the finned aluminum disk aids in removing the heat generated by the grinding wheel or ring.

The grinding wheel assembly 130, due to the use of a diamond plating, will last for many sharpenings, and never requires that the wheel be dressed during the long life thereof. As a result, a highly compact, readily affordable drill sharpener that rivals the accuracy and ease of use of much larger and more expensive industrial sharpeners is provided by this invention.

While the invention has been described above with reference to preferred embodiments thereof, it is to be recognized that modifications and changes to the described embodiments will become apparent to those of ordinary skill in the art, without departing from the spirit and scope of the instant invention. Accordingly, the scope of the invention is to be determined by reference to the appended claims.

What is claimed is:

1. A drill sharpener comprising:

a housing;

a grinding wheel assembly comprising a grinding wheel disposed within said housing;

a drill mounting chuck having a barrel portion;

a pair of peripheral cams carried by the barrel portion of the chuck;

said housing contains at least two chuck receiving ports, said at least two chuck receiving ports including an alignment port having an opening therein for receiving and positioning a drill relative to the chuck and the cams carried by the chuck;

a second port having a chuck receiving opening therein to position the chuck and the drill in operative relation to a grinding surface of the grinding wheel for sharpening said drill;

wherein the alignment port houses a pair of spring clips for engaging a drill to be aligned and subsequently sharpened, said spring clips being mounted such that leading edges of the spring clips are substantially parallel to each other, said spring clips further being biased toward a first closed position at which said leading edges are closely spaced, and means for moving said spring clips to an open position wherein said leading edges are spread apart such that a drill can be inserted past said leading edges in said alignment port, said spring clip moving means further permitting said spring clips to return toward said first position, wherein said leading edges can engage the drill for alignment purposes.

2. A drill sharpener as recited in claim 1 wherein said alignment port has means for retaining a said chuck at a specific desired position and orientation at said port.

3. A drill sharpener as recited in claim 2 wherein said chuck retaining means comprises at least one projection extending inwardly from said opening, and wherein said chuck has a mating surface for aligning with said projection.

4. A drill sharpener as recited in claim 3, wherein said alignment port has an abutment so constructed and arranged to engage a tip of a drill to be aligned, and wherein said abutment and said chuck retaining means are spaced apart at a distance that dictates the desired amount of the length of the drill that is to protrude from the chuck for subsequent sharpening of the drill.

5. A drill sharpener as recited in claim 2 wherein said chuck retaining means is rotatable to a plurality of positions such that said chuck can be selectively oriented for proper alignment of drills having different point geometries.

6. A drill sharpener as recited in claim 5 wherein said second port has means for orienting the chuck receiving opening to a plurality of angles with respect to the grinding surface of the grinding wheel, to thereby permit proper positioning of drills having different point geometries.

7. A drill sharpener as recited in claim 1 wherein said spring clip moving means comprises a single lever that engages each one of said pair of spring clips.

8. A drill sharpener as recited in claim 7 wherein said lever has an actuation arm protruding through an opening in said alignment port enabling operation of said lever by a user.

9. A drill sharpener as recited in claim 1 wherein said chuck has an open back end permitting a drill that is to be mounted in said chuck to be manipulated axially and rotationally to aid in properly aligning the drill in the alignment port prior to the chuck being fully tightened around the drill.

10. A drill sharpener as recited in claim 9 wherein said chuck has a short longitudinal extent, whereby the shank of the drills of most common sizes will extend rearwardly in the chuck such that the shank can be grasped by human fingers.

11. A drill sharpener as recited in claim 10 wherein said chuck has a chuck end piece disposed at a rear extent of said chuck, and said chuck end piece has a hollow cavity extending therethrough in communication with a hollow portion of said barrel, said chuck end piece being so constructed and arranged to be operable to tighten and loosen said chuck around a drill.

12. A drill sharpener as recited in claim 1, wherein said housing contains a third point-splitting port having a chuck receiving sleeve therein to position the chuck, and a surface of the drill to be ground in splitting a point of the drill, in operative relation to said grinding surface of said grinding wheel used to sharpen said drill.

13. A drill sharpener as recited in claim 12, wherein said chuck receiving sleeve in said point-splitting port is pivotable within said housing between a first position at which a drill will not contact said grinding surface and a second position at which a drill will contact said grinding surface, and wherein said chuck receiving opening is biased into said first position by a resilient arm attached to said chuck receiving sleeve.

14. A drill sharpener as recited in claim 1, further comprising a motor disposed in said housing, said motor having a motor shaft extending therefrom, and wherein said grinding wheel assembly is operatively coupled to said motor shaft.

15. A drill sharpener comprising:

a housing;

a grinding wheel assembly comprising a grinding wheel operatively coupled to said motor shaft;

a drill mounting chuck;

a pair of peripheral cams carried by the barrel portion of the chuck;

said housing defining at least one chuck receiving ports having a chuck receiving sleeve therein to position the chuck and a drill in operative relation to a grinding surface of the grinding wheel;

wherein said grinding wheel is made of steel and is of a small diameter, and said grinding surface comprises diamond plated to said grinding wheel;

wherein said motor operates at speeds on the order of 15,000 revolutions per minute, and wherein said grinding wheel assembly is coupled to said motor shaft in a direct drive arrangement;

and wherein said grinding wheel assembly comprises:

an electrically non-conductive hub having a central bore extending through at least a lower portion thereof, said bore being sized to be press fit onto said motor shaft, said non-conductive hub having a cylindrical peripheral surface extending along at least a portion of the longitudinal extent of said hub;

and wherein said grinding wheel comprises a hollow steel cylinder having said diamond plating bonded to an exterior peripheral surface thereof, said steel cylinder being secured to said non-conductive hub, wherein an interior surface of said wheel is mated with said cylindrical peripheral surface of said non-conductive hub; and wherein said grinding wheel assembly further comprises a heat sink disk made of a material having high thermal conductivity secured to an upper extent of said non-conductive hub to secure said grinding wheel in its proper longitudinal position on said hub, and being in intimate contact with said hub to draw heat away from said hub for dissipation into an environment.

16. A drill sharpener as recited in claim 15, wherein said heat sink disk of said grinding wheel assembly is made of aluminum and has fins protruding therefrom.

17. A drill mounting chuck for use with a drill sharpener comprising a hollow barrel portion having a plurality of chuck jaws disposed therein, each of said plurality of chuck jaws being coupled to a backing ring by an associated chuck jaw spring, said chuck jaws being so constructed and arranged to engage a drill on the flutes of the drill, and a chuck end piece disposed at a rear extent of said chuck, said chuck end piece having a hollow cavity extending therethrough in communication with a hollow portion of said barrel, said hollow cavity permitting a drill that is to be mounted in said chuck to be manipulated axially and rotationally to aid in properly aligning the drill relative to the chuck prior to the chuck being fully tightened around the drill, said chuck end piece being operably coupled to said plurality of chuck jaws and being so constructed and arranged to tighten and loosen said chuck jaws around a drill, said chuck further having at least one camming surface adapted to engage an associated camming surface on a drill sharpener.

18. A drill mounting chuck as recited in claim 17, wherein said chuck and chuck jaws are so constructed and arranged to receive and mount therein drills varying in diameter by at least ¼ inch.

19. A grinding wheel assembly for use in a drill sharpener comprising:

an electrically non-conductive hub having a central bore extending through at least a lower portion thereof, said bore being sized to be press fit onto a motor shaft, said non-conductive hub having a cylindrical peripheral surface extending along at least a portion of the longitudinal extent of said hub;

a hollow metal cylindrical grinding wheel having an abrasive cutting medium bonded to an exterior peripheral surface thereof, said metal wheel being secured to said non-conductive hub, wherein an interior surface of said wheel is mated with said cylindrical peripheral surface of said non-conductive hub; and a heat sink disk made of a material having high thermal conductivity secured to an upper extent of said non-conductive hub to secure said grinding wheel in its proper longitudinal position on said hub, and being in intimate contact with said hub to draw heat away from said hub for dissipation into an environment.

20. A grinding wheel assembly as recited in claim 19, wherein said electrically non-conductive hub is made of a high-temperature plastic.

21. A grinding wheel assembly as recited in claim 19, wherein said heat sink disk is made of aluminum and has fins protruding therefrom.

22. A grinding wheel assembly as recited in claim 19, wherein said metal grinding wheel is made of steel.

23. A drill sharpener comprising:

a housing;

a grinding wheel assembly comprising a grinding wheel disposed within said housing;

a drill mounting chuck having a barrel portion;

a pair of peripheral cams carried by the chuck;

wherein said housing contains at least two chuck receiving ports, said at least two chuck receiving ports including an alignment port having an opening therein for receiving and positioning a drill relative to the chuck and the cams carried by the chuck and including a second port having a chuck receiving opening therein to position the chuck and the drill in operative relation to a grinding surface of the grinding wheel for sharpening said drill;

wherein the alignment port houses drill engaging means for engaging a drill to be aligned and subsequently sharpened, said drill engaging means being biased to a closed position, and means for moving said drill engaging means to an open position at which a drill can be inserted into position to be engaged by said drill engaging means, said moving means further permitting said drill engaging means to return toward said closed position, and into contact with said drill, wherein said drill engaging means can engage the drill for alignment purposes.

* * * * *

UNITED STATES PATENT AND TRADEMARK OFFICE

CERTIFICATE OF CORRRECTION

PATENT NO. : 5,735,732
DATED : April 7, 1998
INVENTOR(S) : David A. Bernard It is certified that error appears in the above-identified patent and that said Letters Patent is hereby corrected as shown below:

On the title page, under item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 4 | 5 | 5 | 7 | 8 | 6 | 6/26/84 | Maysilles | | | |
| | | 4 | 7 | 4 | 2 | 6 | 4 | 8 | 5/10/88 | Ketteringham | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 4 | 0 | 5 | 3 | 3 | 8 | 02.01.91 | European | | | | |
| | | | | | | | | | | | | | | |

Signed and Sealed this

Second Day of March, 1999

*Attest:*

Q. TODD DICKINSON

*Attesting Officer*

*Acting Commissioner of Patents and Trademarks*